US010128586B2

(12) United States Patent
Göttl et al.

(10) Patent No.: US 10,128,586 B2
(45) Date of Patent: Nov. 13, 2018

(54) PLUG CONNECTOR FOR MAKING SOLDER-FREE CONTACT WITH A COAXIAL CABLE

(71) Applicant: KATHREIN-WERKE KG, Rosenheim (DE)

(72) Inventors: Maximilian Göttl, Frasdorf (DE); Manfred Stolle, Bad Aibling (DE); Thomas Haunberger, Bad Reichenhall (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 15/558,387

(22) PCT Filed: Mar. 18, 2016

(86) PCT No.: PCT/EP2016/056015
§ 371 (c)(1),
(2) Date: Sep. 14, 2017

(87) PCT Pub. No.: WO2016/146828
PCT Pub. Date: Sep. 22, 2016

(65) Prior Publication Data

US 2018/0062281 A1 Mar. 1, 2018

(30) Foreign Application Priority Data

Mar. 19, 2015 (DE) ..... 10 2015 003 579

(51) Int. Cl.
*H01R 9/05* (2006.01)
*H01R 24/40* (2011.01)
*H01R 103/00* (2006.01)

(52) U.S. Cl.
CPC ..... *H01R 9/0524* (2013.01); *H01R 9/0503* (2013.01); *H01R 9/0518* (2013.01);
(Continued)

(58) Field of Classification Search
CPC ..... H01R 17/12; H01R 9/0521; H01R 103/00
(Continued)

(56) References Cited

U.S. PATENT DOCUMENTS 3,716,904 A 2/1973 Ziegler, Jr.
4,906,207 A 3/1990 Banning et al.
(Continued)

FOREIGN PATENT DOCUMENTS

DE 33 14 865 10/1984
DE 41 00 600 9/1991
(Continued)

OTHER PUBLICATIONS

English translation of the International Preliminary Report on Patentability and Written Opinion of the International Searching Authority dated Sep. 28, 2017, issued in corresponding International Application No. PCT/EP2016/056015.
(Continued)

*Primary Examiner* — Phuong Chi T Nguyen
(74) *Attorney, Agent, or Firm* — Nixon & Vanderhye P.C.

(57) ABSTRACT

A plug connector has an outer conductor socket to receive a coaxial cable. An inner conductor receiving element receives an inner conductor of the coaxial cable and is arranged in a centered manner within the outer conductor socket. The outer conductor socket has at least one contact-making area which makes electrical contact with an outer conductor of the coaxial cable. At least one separating element is arranged within the outer conductor socket in such a way that making electrical contact with the end of the outer conductor of a coaxial cable that can be or is inserted into the outer conductor socket and the outer conductor socket is prevented or suppressed. In the plugged-in state, the contact-making area is arranged in the outer conductor
(Continued)

socket in such a way that electrical contact can be or is made radially with the circumferential wall adjoining the end.

20 Claims, 6 Drawing Sheets

(52) U.S. Cl.
CPC ..... *H01R 9/0521* (2013.01); *H01R 24/40* (2013.01); *H01R 2103/00* (2013.01)

(58) Field of Classification Search
USPC ..... 439/578, 584, 583
See application file for complete search history.

(56) References Cited

U.S. PATENT DOCUMENTS

| | | | | |
|---|---|---|---|---|
| 6,019,635 | A | 2/2000 | Nelson | |
| 6,840,803 | B2 * | 1/2005 | Wlos | H01R 9/0518 439/578 |
| 6,860,761 | B2 * | 3/2005 | Lee | H01R 4/28 439/582 |
| 9,136,654 | B2 * | 9/2015 | Matzen | H01R 24/38 |
| 9,548,572 | B2 * | 1/2017 | Burris | H01R 9/0521 |
| 2012/0129375 | A1 | 5/2012 | Van Swearingen | |

FOREIGN PATENT DOCUMENTS

| | | |
|---|---|---|
| DE | 697 04 471 | 8/2001 |
| DE | 102 51 905 | 7/2003 |
| DE | 103 59 605 | 7/2005 |

OTHER PUBLICATIONS

International Search Report for PCT/EP2016/056015, dated Jun. 15, 2016, 5 pages.
Written Opinion of the ISA for PCT/EP2016/056015, dated Jun. 15, 2016, 6 pages.

* cited by examiner

PLUG CONNECTOR FOR MAKING SOLDER-FREE CONTACT WITH A COAXIAL CABLE

This application is the U.S. national phase of International Application No. PCT/EP2016/056015 filed 18 Mar. 2016, which designated the U.S. and claims priority to DE Patent Application No. 102015003579.7 filed 19 Mar. 2015, the entire contents of each of which are hereby incorporated by reference.

The invention relates to a plug connector for receiving and contacting a coaxial cable.

Plug connectors in general are used for disconnecting and connecting electrical lines so as to transmit current and/or in particular electrical signals via said lines. They may involve multiple or single plugs.

In the field of plug connectors, coaxial plug connections are of particular importance; they comprise an inner conductor and an outer conductor and generally an outer conductor sheath, the inner conductor being electrically/galvanically separated from the outer conductor using a dielectric.

It is desirable for the coaxial cable to be able to be brought into contact with the plug connector in as simple a manner as possible. In particular, the connection between the coaxial cable and the plug connector, which may be configured as a plug or as a socket, may be provided without a soldered connection.

U.S. Pat. No. 8,550,843 B2 discloses a plug connector for receiving a coaxial cable. Therein, the dielectric between the inner conductor and the outer conductor is removed in part, in such a way that both the inner conductor and the outer conductor are freely accessible. The part of the outer conductor which is no longer directly connected to the dielectric is subsequently folded radially outwards and electrically contacted.

A drawback of U.S. Pat. No. 8,550,843 B2 is that the preparation of the coaxial cable before it can be contacted with the plug connector is very complex. Thus, the outer conductor can only protrude from the dielectric by a very precisely defined distance, or else the electrical connection of the outer conductor cannot be precisely reproduced.

Therefore, the object of the present invention is to provide a plug connector which makes it possible to receive a coaxial cable in as simple a manner as possible, it being possible to reproduce the fastening of the coaxial cable with respect to the electrical contact thereof and it being possible to implement said fastening in as simple a manner as possible, in other words without additional soldering points.

The object is implemented by the plug connector according to independent claim 1. Advantageous developments of the plug connector according to the invention are to be found in the dependent claims.

The plug connector according to the invention comprises an outer conductor socket for receiving a coaxial cable, a central axis passing through the outer conductor socket. The plug connector further comprises an inner conductor receiving element for receiving an inner conductor, said element being arranged so as to be centred within the outer conductor socket. The outer conductor socket also comprises a contact region for electrically contacting an outer conductor of a coaxial cable which is to be received or has been received. The coaxial cable which is to be received or has been received is rigidly connected or connectable to at least one portion of the outer conductor socket via a mechanical fastening. The plug connector comprises at least one separation element, which is arranged within the outer conductor socket in such a way that electrical contact of the end face of the outer conductor of a coaxial cable, which can be or has been inserted into the outer conductor socket, with the outer conductor socket is impeded or prevented. Furthermore, in the plugged-in state, the contact region is arranged in the outer conductor socket in such a way that the peripheral wall, which is adjacent to the end face, of the outer conductor is electrically contactable or contacted radially, preferably electrically contactable or contacted exclusively radially. In this context, it is particularly advantageous that the outer conductor of the coaxial cable is electrically contacted solely at precisely defined points. In this case, the electrical contact is solely radial, in such a way that there is no flow of current via the end face, since this is prevented by the separation element, which is preferably a dielectric material.

Furthermore, in the plug connector according to the invention, it is advantageous if the outer conductor socket comprises a projection projecting towards the central axis, against which the end face of the outer conductor and/or against which at least one part of a dielectric between the outer conductor and the inner conductor of the insertable or inserted coaxial cable is braced. This provides that the coaxial cable can be inserted into the outer conductor socket as far as a defined stop. This stop can be provided solely by the at least one part of the dielectric, and not by the outer conductor itself or additionally thereby, and so the projection can also consist of an electrically conductive material.

The electrical contact between the end face of the outer conductor of the coaxial cable insertable or inserted into the outer conductor socket and the outer conductor socket is impeded or prevented:

a) in that the projection is formed from or coated with a dielectric material and thus forms the separation element; or
b) in that the separation element is formed as a separate separation element, which is positioned between the projection and the end face of the outer conductor and/or of the at least one part of the dielectric of the insertable coaxial cable; or
c) in that the dielectric of the coaxial cable protrudes beyond the outer conductor at the end face and is braced on the projection or on the separation element or on the dielectric of the plug connector.

In this case, it is advantageous that the projection may simultaneously be the separation element or that the separation element is a separate separation element which is braced for example on the projection. In particular, as a result of the dielectric protruding beyond the outer conductor, it is ensured that the end face of the outer conductor cannot be electrically contacted with an electrically conductive projection or separation element.

Furthermore, the separation element is constructed in such a way that it has, on the face thereof facing the end face of the coaxial cable which is to be received or has been received, a conical or pyramidal elevation, through which an opening for receiving the inner conductor passes in the region of the central axis. This has the additional advantage that the separating disc cuts at least in part into the dielectric between the inner conductor and the outer conductor of the coaxial cable which is to be received or has been received. During subsequent, exclusively radial contact, it is ensured that the outer conductor of the coaxial cable cannot be pressed towards the inner conductor. In this case, the height of the elevation of the separation element is preferably the same as the length of the contact region in the axial direction.

The projection is at an angle of between 80° and 100°, preferably of between 85° and 95° and more preferably of 90°, to the outer conductor socket and/or to the contacting region.

This provides that the coaxial cable is arranged so as to be centred in the outer conductor socket.

The contacting region further comprises contact ribs and/or contact ridges which are arranged so as to be uniformly and mutually offset about the central axis in the peripheral direction on the inner wall of the outer conductor socket. This causes the outer conductor of the coaxial cable to be electrically contacted uniformly.

In addition, the plug connector further comprises a mechanical fastening, which may be formed by way of a portion of the outer conductor contacting socket, the mechanical fastening being achieved by means of a crimped and/or clamped connection. A clamped connection also includes a screw connection.

The plug connection may also be constructed in such a way that an end portion of the outer conductor socket, at which portion the mechanical fastening engages, is at an axial distance from the contact region via which the outer conductor socket is electrically contacted with the outer conductor of the insertable or inserted coaxial cable. Therefore, pulling on the coaxial cable does not bring about a change in the electrical contact. Preferably, the contact region via which the outer conductor socket is electrically contacted with the outer conductor of the insertable or inserted coaxial cable is arranged closer to the inner conductor receiving element than the end portion of the outer conductor socket, at which portion the mechanical fastening engages.

The plug connector may also be constructed in such a way that the end portion of the outer conductor socket is widened radially outwards away from the central axis, forming a receiving chamber for a clamping ring, in such a way that, as a result of the clamping ring being screwed into the receiving chamber in the end portion of the outer conductor socket, radial contact pressure forces act between the clamping ring and the coaxial cable to be fastened.

The plug connector may also be constructed in such a way that the end portion of the outer conductor socket is positioned on the outer conductor of the coaxial cable to be fastened and that a clamping ring is screwed radially onto the end portion of the outer conductor socket, in such a way that radial contact pressure forces act between the clamping ring and the coaxial cable to be fastened.

Finally, the plug connector is also constructed in such a way that the contact region of the outer conductor socket contacts the region at the peripheral wall of the outer conductor of coaxial cable which can be or is supplied and which, starting at the end face, extends in the axial direction by less than 0.5 cm, preferably less than 0.3 cm and more preferably less than 0.2 cm. This means that the electrical contact takes place right at the beginning of the coaxial cable, and particularly good intermodulation properties are thus ensured.

Various embodiments of the invention are disclosed in the following by way of example with reference to the drawings. Like objects have the same reference numerals. In the corresponding figures of the drawings, in detail:

Figure 1A:
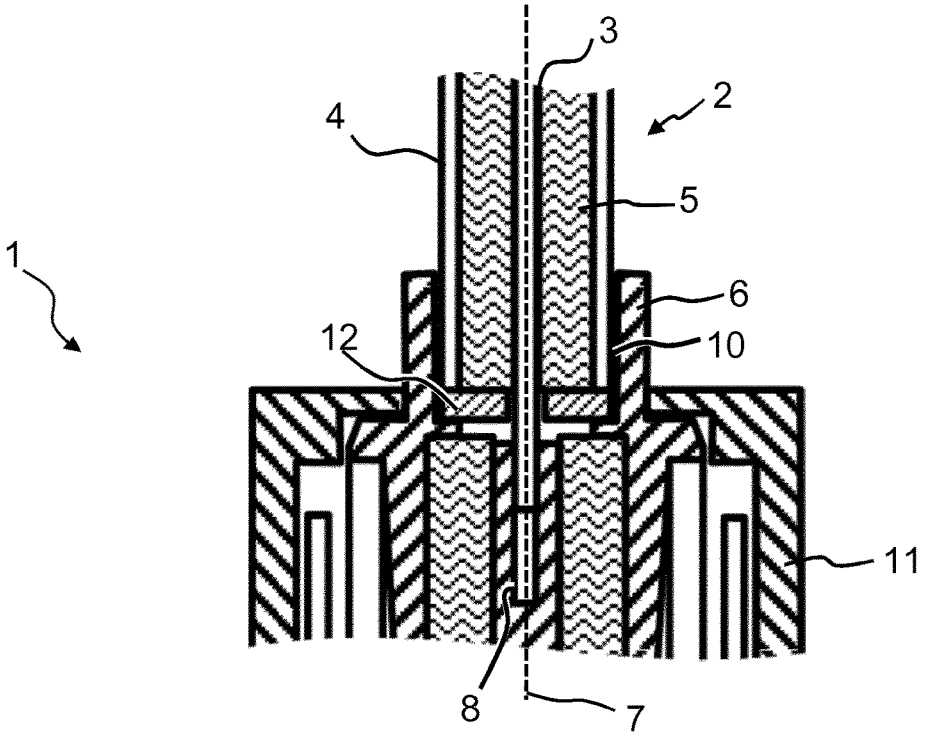
FIG. 1A, 1B are simplified drawings of the plug connector according to the invention for receiving a coaxial cable, in one case in the form of a plug and in one case in the form of a socket.

FIG. 1A is a simplified longitudinal section through the plug connector 1 according to the invention for receiving a coaxial cable 2 in the form of a plug. The coaxial cable 2 comprises an inner conductor 3, an outer conductor 4, and a dielectric 5 arranged between the inner conductor 3 and the outer conductor 4. A protective sheathing (not shown) is also additionally located over the outer conductor 4.

The plug connector 1 also comprises an outer conductor socket 6. Said socket is designed to receive the coaxial cable 2 and for clearer illustration a central axis 7 passes therethrough. The plug connector 1 also further comprises an inner conductor receiving element 8. Said element is designed to receive the inner conductor 3 of the coaxial cable 2 and comprises for example a spring bush. In this case, the inner conductor receiving element 8 is preferably arranged so as to be centred within the outer conductor socket 6. The central axis 7 preferably likewise extends centrally through the inner conductor receiving element 8.

The outer conductor socket 6 comprises at least one contact region 10, which is designed to electrically contact the outer conductor 4 of the coaxial cable 2. The contact region 10 extends in the axial direction merely over part of an inner wall 21 of the outer conductor socket 6, or else extends over the entire region of the inner wall 21 of the outer conductor socket 6. The electrical contact preferably takes place entirely via the contact region 10 of the outer conductor socket 6 with the outer conductor 4 of the coaxial cable 2 which is to be received or has been received, without the assistance of solder, in other words exclusively in a solder-free manner. This means that in particular no solder is introduced between the outer conductor 4 and the electrical contact region 10. The same preferably also applies to the inner conductor 3 of the coaxial cable 2. This is electrically conductively connected to the inner conductor receiving element 8 without the use of solder.

The plug connector 1 also further comprises a separation element 12. The separation element 12 is preferably a dielectric in the form of a disc which has an opening in the centre thereof. The inner conductor 3 of the coaxial cable 2 to be received is guided through the opening. The separation element 12 is designed to support the coaxial cable 2 to be received and, in addition, the separation element 12 is intended to prevent currents from flowing via the end face of the outer conductor 4 of the coaxial cable 2 to be received. The outer conductor 4 of the coaxial cable 2 to be received is contacted in the radial direction solely, in other words exclusively, by the contact region 10 of the outer conductor socket 6.

The separation element 12 may be of various diameters. It is possible for the diameter of the separation element 12 to be less than the diameter of the coaxial cable 2 to be received. In this case, the separation element 12 acts as a spacer, the end face of the outer conductor 4 of the coaxial cable 2 to be received being galvanically separated from the outer conductor socket 6 by air.

The diameter of the separation element 12 may also be selected in such a way that it corresponds to the diameter of the coaxial cable 2 to be received, excluding the protective sheathing (not shown). In this case, the separation element 12 supports not only the dielectric 5 of the coaxial cable but also the outer conductor 4. A flow of current is thus also only provided in the radial direction via the contact region 10.

However, the diameter of the separation element 12 may also be greater than the diameter of the coaxial cable 2 to be received. The diameter of the separation element 12 is preferably greater by a factor of 10, more preferably by a factor of 20, than the thickness of the separation element 12. It is likewise possible for the separation element 12 not to have the cross-sectional shape of a disc, but rather for example that of a rectangle or of an n-gon. In this case, it is also ensured that the separation element 12 cannot be twisted within the outer conductor socket 6.

The face of the separation element 12 remote from the end face of the coaxial cable 2 to be received may for example be provided with an electrically conductive coating. This means that less stray radiation can advance towards the inner conductor receiving element 8.

The separation element 12 is preferably. Furthermore, when the plug connector 1 is assembled with the coaxial cable 2, solder is preferably entirely omitted.

A coupling ring 11 is also shown, which is designed to mechanically rigidly connect the plug connector 1 in the form of a plug to the matching part thereof. In this case, the outer conductor socket 6 protrudes beyond the coupling ring 11 in parallel with the central axis 7.

Plug means for connecting the plug connector 1 in the form of a plug to the corresponding matching part, in other words to a plug connector 1' in the form of a socket, are provided opposite each other on the outer conductor socket 6.

Figure 1B:
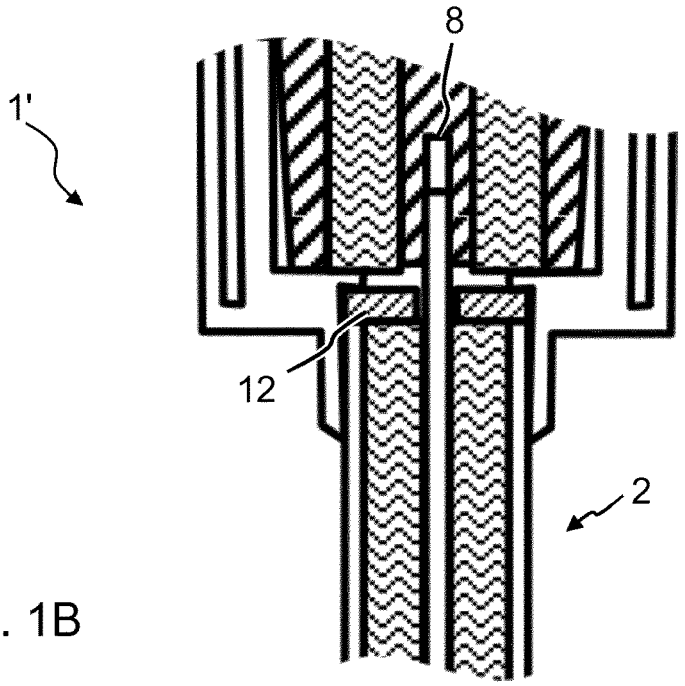

A plug connector 1' of this type in the form of a socket is shown in FIG. 1B. The coaxial cable 2 is received analogously to the plug connector 1 shown in FIG. 1A.

Figure 1C:
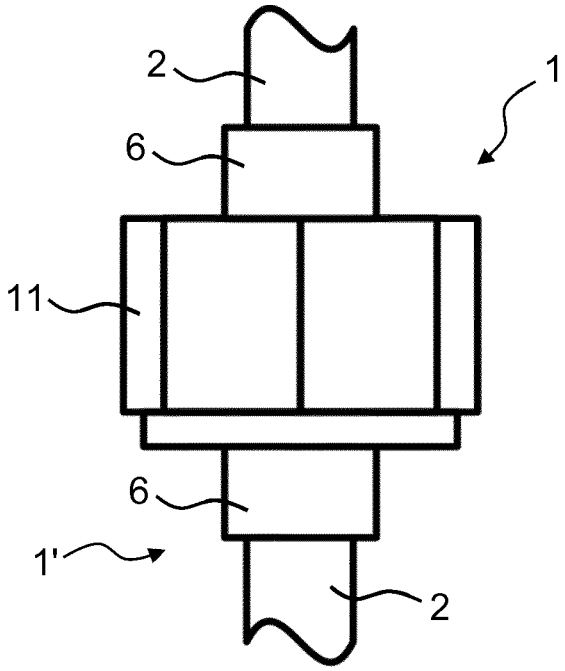
FIG. 1C shows the two plug connections in the form of a plug and a socket, which are screwed together.

FIG. 1C shows the two plug connections 1, 1' in the form of a plug and a socket respectively which can be interconnected by means of the coupling ring 11. The coupling ring 11 may for example be a hexagonal nut.

Figure 2A:
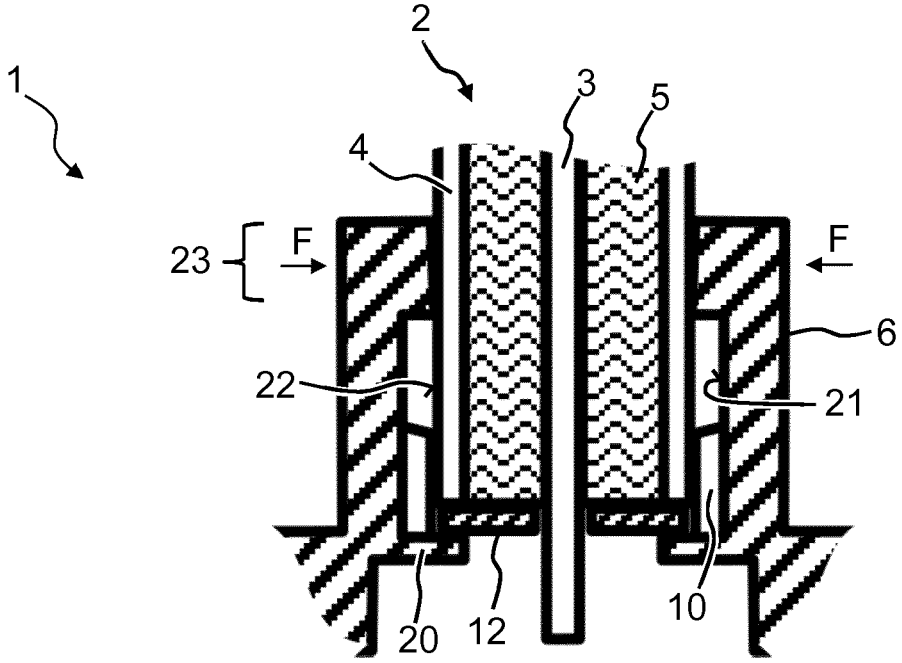
FIG. 2A is a longitudinal section through the plug connection with the received coaxial cable, the electrical contact being separate from the mechanical fastening.

FIG. 2A is a longitudinal section through the plug connection 1 according to the invention with a received coaxial cable 2, the electrical contact being separate from the mechanical fastening. The coaxial cable 2 is again inserted into the outer conductor socket 6. The outer conductor 4 of the coaxial cable 2 is connected via the contact region 10 to the outer conductor socket 6 of the plug connector 1. The coaxial cable 2 is supported at the end face thereof at least in part on the separation element 12. In the embodiment of FIG. 2A, the separation element 12 is supported at least in part on a projection 20. The projection 20 is preferably formed in a single piece with or formed integrally on the outer conductor socket 6. The projection 20 likewise extends preferably radially about the central axis 7. It is also possible for the projection 20 simultaneously to form the separation element 12. In this case, the projection 20 is preferably manufactured from or coated with a non-conductive electric medium. The thickness of the projection 20 in the axial direction, in other words parallel to the central axis 7, approximately corresponds to the thickness of the separation element 12. However, the separation element 12 may also be thicker or thinner than the projection 20.

The inner conductor 3 of the coaxial cable 2 to be received is guided through the opening in the separation element 12. The separation element 12 is thus restricted in the movement thereof in the radial direction, in other words perpendicularly to the central axis 7. The separation element 12 may be of such a large diameter that it is, for example, directly adjacent to or braced on an inner wall 21 of the outer conductor socket 6.

In the example of FIG. 2A, the diameter of the separation element 12 is approximately as large as the diameter of the coaxial cable 2 to be received, resulting in a gap in the radial direction between the separation element 12 and the inner wall 21 of the outer conductor socket 6.

A contact region 10 is integrally formed on the inner wall 21 of the outer conductor socket 6. This contact region 10 may start directly above the projection 20 and extend towards the coaxial cable 2 to be received. This means that the contact region 10 is in contact in part both with a peripheral face of the separation element 12 and with part of the outer conductor 4 of the coaxial cable 2 to be received. It is also possible for the contact region 10 only to start above a surface of the separation element 12.

The contact region 10 is preferably configured free from interruptions. In particular, it has no interruptions in the axial direction.

The contact region 10 may for example be formed by contact ribs and/or by contact ridges. In this case, the contact region 10 may also be formed in a single piece with the outer conductor socket 6.

The contact region 10, in other words the contact ribs and/or the contact ridges, preferably comprise cutting edges, which more preferably extend in parallel with or helically about the central axis 7. When pressed in the radial direction as indicated by the arrows in FIG. 2A, these therefore cut into the outer conductor 4 of the coaxial cable 2 to be received and establish electrical contact.

An upper end of the contact ribs and/or of the contact ridges, in other words of the contact region 10, extends obliquely downwards from radially outside to radially inside, in other words towards the projection 20, and therefore acts as an insertion aid when the coaxial cable 2 to be received is inserted. An upper face of the contact region 10 is the face of the contact region 10 arranged furthest away from the projection 20. The upper face of the contact region 10 may also have a curved progression.

When the coaxial cable 2 is plugged in, the contact region 10 contacts the outer conductor 4 at the peripheral wall 22 thereof adjacent to the end face. This contact takes place exclusively radially. In this case, the contact region 10 contacts the region on the peripheral wall 22 of the outer conductor 4 of the inserted coaxial cable 2 at the region which extends away from the separation element 12 by less than 0.5 cm, preferably by less than 0.3 cm and more preferably by less than 0.2 cm, in the axial direction starting at the end face.

At the end thereof furthest away from the inner conductor receiving element 8, the outer conductor socket 6 is curved radially inwards, in other words towards the central axis 7, in part or extends towards the central axis 7 at least in part. This region is also the end portion 23 via which a mechanical fastening connects the plug connector 1 to the received coaxial cable 2. In the embodiment of FIG. 2A, the mechanical fastening is a crimped and/or clamped connection. A crimped connection is a non-detachable connection. In this case, a force is applied to the end portion 23 of the outer conductor socket 6 in accordance with the arrows shown in FIG. 2A. This force leads to a deformation of the end portion 23 of the outer conductor socket 6, which is pressed radially inwards, in other words towards the central axis 7. As a result, the contact region 10 is likewise pressed towards the outer conductor 4 of the inserted coaxial cable 2, causing the electrical contact between the outer conductor socket 6 and the outer conductor 4 of the coaxial cable 2 to take place. The fact that the end portion 23 likewise electrically contacts the outer conductor 4 is irrelevant, since the currents in the outer conductor 4 chose the shortest path and this extends exclusively via the contact region 10. If a precisely defined force is applied when the crimped and/or clamped connection is established, the electrical contact via the contact region 10 can be reproduced.

In this case, it is particularly advantageous that the mechanical fastening takes place at an axial distance from the region used for electrical contacting. The mechanical fastening is thus at an axial distance from the contact region 10. This means that shaking at the coaxial cable 2 does not lead to the electrical contact being impaired. In this case, the mechanical fastening is further away from the inner conductor receiving element 8 than the electrical contact.

The end portion 23 extends in the axial direction over approximately the same length over which the contact region 10 also extends.

The projection 20 and the outer conductor socket 6 and/or the contact region 10 are at an angle to one another which is in the range of between 70° and 110°, preferably between 80° and 100°, more preferably between 85° and 95°, and may for example be 90°. When the coaxial cable 2 is inserted and the mechanical fastening is applied, the angle between the projection 20 and the outer conductor socket 6 or the contact region 10 changes in such a way that it is preferably no longer 90° but is still in the range between 70° and 110°, preferably in the range between 80° and 100° and more preferably in the range between 85° and 95°. This ensures that the contact region 10, which for example consists of contact ribs and/or contact ridges, can cut into the outer conductor 4 of the coaxial cable 2.

Figure 2B:
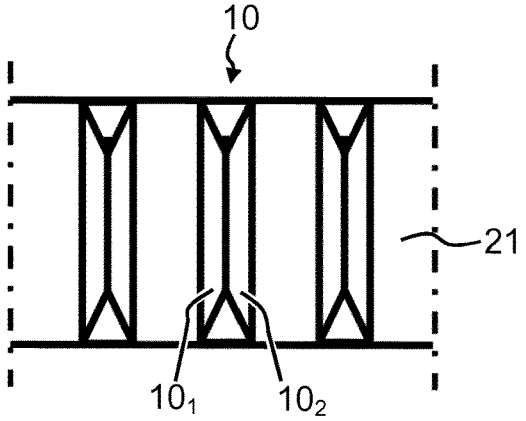
FIG. 2B shows an unrolled inner wall of the outer conductor, which has contact regions in the form of perpendicularly arranged contact ribs and/or contact ridges.

FIG. 2B shows an unrolled inner wall 21 of the outer conductor socket 6, which has contact regions 10 in the form of perpendicularly arranged contact ribs and/or contact ridges. The contact ribs and/or contact ridges are arranged so as to be uniformly and mutually offset about the central axis 7, and thus preferably so as to be parallel to the central axis, in the peripheral direction on the inner wall 21 of the outer conductor socket 6. This means that the distances in the peripheral direction between the individual contact ribs and/or the individual contact ridges are approximately equal in each case.

The contact region 10 preferably has m contact ribs and/or contact ridges, where $m \geq 2$, preferably $m \geq 3$, more preferably $m \geq 4$, more preferably m 5, more preferably $m \geq 6$, and the contact ribs and/or the m contact ridges being arranged at an angle to one another of $\alpha = 360°$ over m.

The contact ribs and/or the contact ridges have cutting edges which extend in parallel with or helically about the central axis 7. The cutting edges are preferably formed by two side faces $\mathbf{10}_1$ and $\mathbf{10}_2$ which taper towards one another. The cutting edges, in other words the contact region 10, preferably consist of the same material of which the outer conductor socket 6 also consists.

Figure 3:
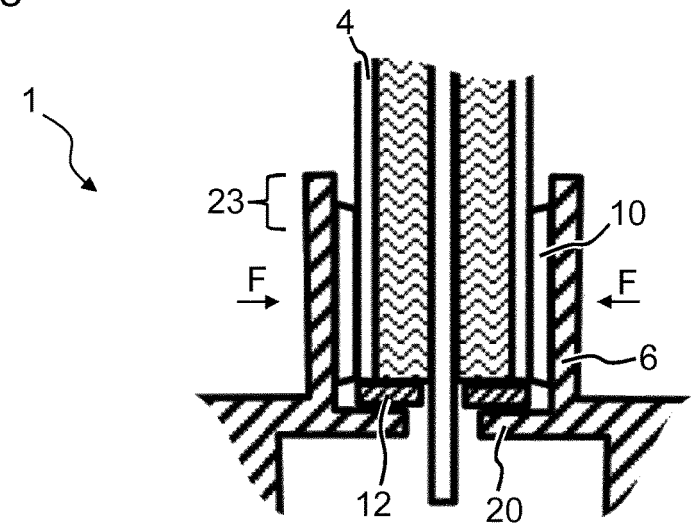
FIG. 3 is a longitudinal section through the plug connection with the received coaxial cable, the electrical contact and the mechanical fastening not being physically separate.

FIG. 3 is a longitudinal section through another embodiment of the plug connector 1 according to the invention with the received coaxial cable 2, the electrical contact and the mechanical fastening not being physically separate. The contact region 10 has a greater length in the axial direction in FIG. 3 than in FIG. 2A. The arrows show an action of force for establishing the mechanical fastening. This action of force also takes place at the regions at which the contact region 10 is formed.

In the embodiment of FIG. 3, the outer conductor socket 6 has neither a tapering nor a widening at the end portion 23 thereof. It thus changes neither in external diameter nor in internal diameter.

In the embodiment of FIG. 3, the contact region 10 only starts above the separation element 12, meaning that the separation element 12 can be formed in such a way that it is directly adjacent to the outer conductor socket 6. In the embodiment of FIG. 3, however, the external diameter of the separation element 12 is less than the internal diameter of the outer conductor socket 6. In the gap between the separation element 12 and the outer conductor socket 6, for example, an adhesive may further be inserted, which ensures that the separation element 12 is fastened to the outer conductor socket 6 inside said socket. It is likewise possible for the lower face of the separation element 12, in other words the face remote from the end face of the coaxial cable 2, to be non-detachably fastened to the projection 20 by way of an adhesive connection.

The contact region 10 may extend for example as far as the upper end of the outer conductor socket 6, in other words as far as the upper end of the end portion 23. In the embodiment of FIG. 3, however, the contact region 10 ends before the upper end of the outer conductor socket 6 at a particular distance in the axial direction, in other words in parallel with the central axis 7. This distance may be selected as desired.

Figure 4:
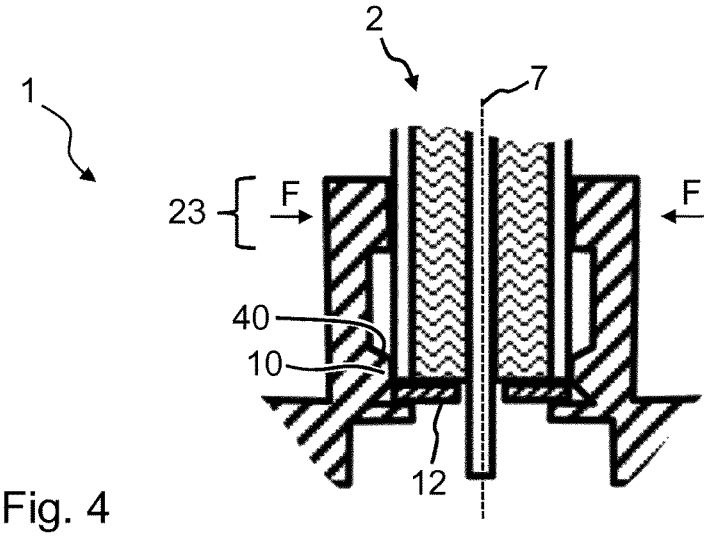
FIG. 4 is a longitudinal section through the plug connection with the received coaxial cable, the electrical contact being separate from the mechanical fastening and the contact region and the outer conductor socket being formed in a single piece.

FIG. 4 is a longitudinal section through a further embodiment of the plug connection 1 according to the invention with the received coaxial cable 2, the electrical contact being separate from the mechanical fastening, and the contact region 10 and the outer conductor socket 6 being formed in a single piece. The contact region 10 preferably likewise consists of individual mutually separated segments which contribute to the electrical contact as a result of a pressure from radially outside to radially inside. In FIG. 4 too, the contact region 10 is inclined at the upper end 40 thereof from radially outside to radially inside towards the separation element 12, making it possible for a coaxial cable 2 to be received to be introduced in as simple a manner as possible. The mechanical fastening takes place analogously to the embodiment of FIG. 2A.

Figure 5A:
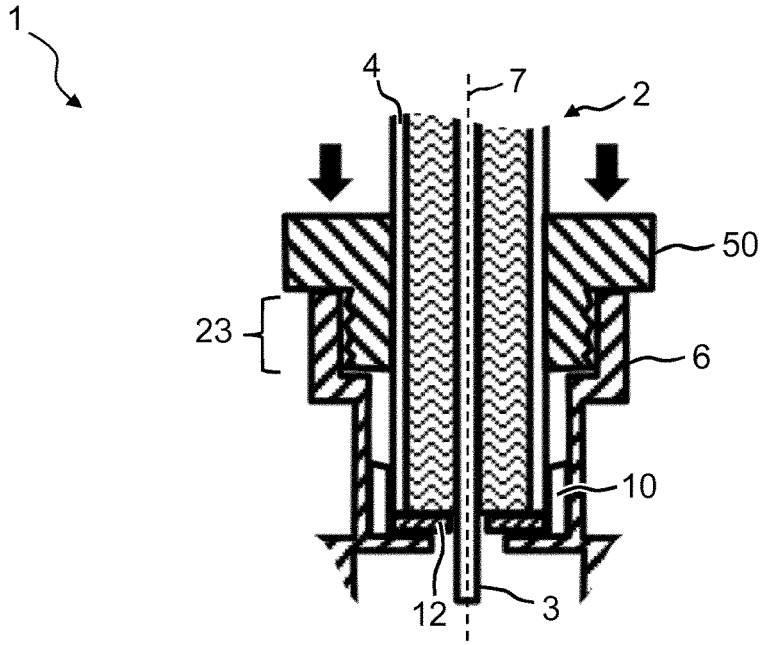
FIG. 5A is a longitudinal section through the plug connection with the received coaxial cable, the electrical contact being separate from the mechanical fastening and a clamping ring, which is screwed between the outer conductor socket and the coaxial cable, providing the mechanical fastening.

FIG. 5A is a longitudinal section through an embodiment of the plug connector 1 according to the invention with the received coaxial cable 2, the electrical contact being separate from the mechanical fastening, and a clamping ring 50 being screwed between the outer conductor socket 6 and the coaxial cable 2 and providing the mechanical fastening. The end portion 23 of the outer conductor socket 6 widens radially outwards, in other words away from the central axis 7. This widening may be configured tapered, conical or curved in longitudinal section. Preferably, the progression of the widening of the end portion 23 is selected in such a way that it is constant in longitudinal section for each point. An introduced clamping ring 50 is therefore pressed by the end portion 23 of the outer conductor socket 6 towards the coaxial cable 2 to be received, resulting in the mechanical fastening.

Preferably, the inner wall of the end portion 23 of the outer conductor socket 6 has a thread. The outer wall of the clamping ring 50 has a corresponding matching part. The clamping ring 50 may also be self-grooving. The further downward the clamping ring 50 is screwed in the axial direction, in other words towards the separation element 12, the stronger a force acts radially inwardly, in other words towards the central axis 7, and the stronger the mechanical fastening.

The clamping ring 50 has a part in the axial direction of which the external diameter is greater than the external diameter of the end portion 23 of the outer conductor socket 6. Another part of the clamping ring 50 has an external diameter which is in turn less than an external diameter of the end portion 23 of the outer conductor socket 6. As a result of the clamping ring 50 being screwed in, a force acts thereon, in such a way that the clamping ring 50 is pressed radially inwards, resulting in the mechanical fastening. The start of the widening part of the outer conductor socket 6 can act as a stop, as far as which point the clamping ring 50 can be screwed in.

Figure 5B:
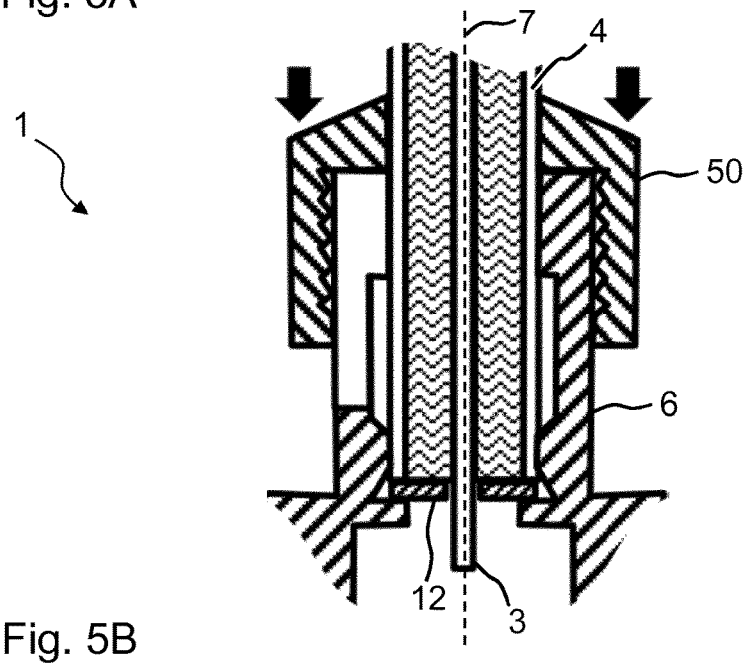
FIG. 5B is a longitudinal section through the plug connection with the received coaxial cable, the electrical contact being separate from the mechanical fastening and the clamping ring being screwed over the outer conductor contact socket.

FIG. 5B is a longitudinal section through another embodiment according to the invention of the plug connection 1 with the received coaxial cable 2, the electrical contact being separate from the mechanical fastening, and the clamping ring 50 being screwed over the outer conductor socket 6 and thus providing the mechanical fastening. In this case, an internal diameter of at least part of the clamping ring 50 is greater than an internal diameter of the end portion 23 of the outer conductor socket 6. The clamping ring 50 likewise in turn has a thread which engages in a corresponding counter thread on the peripheral wall of the end portion 23 of the outer conductor socket 6. Since the internal diameter of the clamping ring 50 is slightly less than the external diameter of part of the end portion 23 of the outer conductor socket 6, a mechanical tension occurs between the clamping ring 50 and the outer conductor socket 6, resulting in a force being generated which presses the end portion 23 of the outer conductor socket 6 radially inwards, in other words towards the central axis 7. The end portion 23 of the outer conductor socket 6 has a slightly conical shape as regards the peripheral wall thereof. The end portion 23 tapers towards the upper end thereof and thus away from the separation element 12 thereof, the external diameter of the upper end being less than the internal diameter of the clamping ring 50.

Figure 5C:
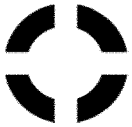
FIG. 5C is a cross section through the outer conductor contact socket and/or through the clamping ring, which illustrates that the outer conductor contact socket and/or the clamping ring are designed to be slotted.

FIG. 5C is a cross section through the outer conductor socket 6 and/or through the clamping ring 50, which shows that the outer conductor socket 6 and/or the clamping ring 50 are slotted. This is already shown in longitudinal section for the outer conductor socket 6 in FIG. 5B. A slotted design of this type makes it possible for the outer conductor socket 6 to be able to taper slightly in diameter, by the individual segments moving closer together. The same also applies to an at least in part slotted design of the clamping ring 50. Preferably, the radially overlapping portions of the outer conductor socket 6 and of the clamping ring 50 are designed to be slotted. In this case, the slot is formed predominantly in the axial direction, in other words in parallel with the central axis 7. The region of the outer conductor socket 6 in which the contact region 10 is formed is preferably not designed to be slotted.

Figure 6:
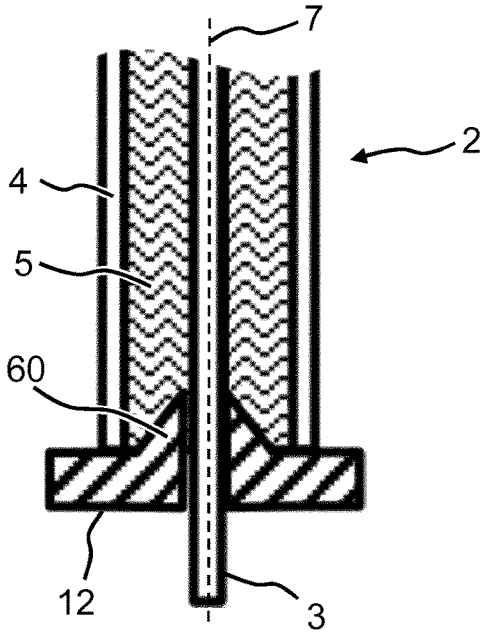
FIG. 6 is an embodiment of a longitudinal section through a separation element, which is positioned on the end face of the received coaxial cable and comprises a pyramidal or conical elevation towards the coaxial cable, through which elevation an opening for receiving the inner conductor passes.

FIG. 6 is a longitudinal section through an embodiment of a separation element 12 which is positioned on the end face of a received coaxial cable 2. By contrast with the disc-shaped separation elements 12 of the previous embodiments, the separation element 12 of FIG. 6 comprises, on the face thereof positioned facing the end face of the received coaxial cable 2, a conical or pyramidal elevation 60, through which an opening for receiving the inner conductor 3 passes in the region of the central axis 7. The conical or pyramidal elevation 60 is preferably not interrupted in the peripheral direction. However, it may also be designed to be slotted. The elevation 60 preferably occurs solely in the region of the end face of the coaxial cable 2 to be received in which the dielectric 5 is formed. This means that the end face of the outer conductor 4 is not damaged by the elevation 60. The elevation 60 means that the coaxial cable 2 to be received is held better and that a pressure from the contact region 10 does not result in the outer conductor 4 being displaced radially inwards, in other words towards the central axis 7. The elevation 60 extends in the axial direction preferably over a length approximately corresponding to the thickness of the separation element at the point at which the elevation 60 is not formed. However, the height of the elevation 60 in the longitudinal direction, in other words parallel to the central axis 7, may also be greater or smaller.

The elevation 60 has a constant inclination over part of the length thereof or over the entire length thereof. It is also possible for the elevation 60 to be described by a polynomial of degree n, where $n \geq 2$, over part of the length thereof.

Figure 7A:
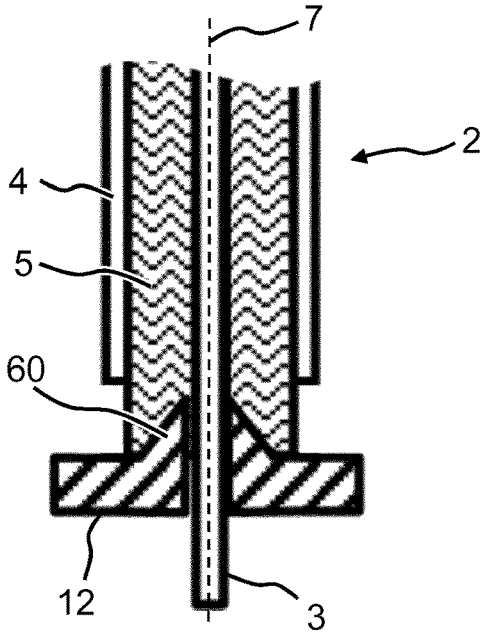
FIG. 7A is a longitudinal section through an embodiment of a separation element on which exclusively the received coaxial cable is positioned.

FIG. 7A is a longitudinal section through an embodiment of a separation element 12, on which exclusively the dielectric 5 of the coaxial cable 2 is positioned. The coaxial cable 2 is formed in such a way that the dielectric 5 has a projecting end with respect to the outer conductor 4 of the coaxial cable 2. This makes it possible for the separation element 12 to be producible from an electrically conductive material. The separation element 12 may also be constructed in accordance with that of any of FIG. 1A to 5B, and be designed to be smooth, in other words without an elevation. It is also possible for the projection 20 to form the separation element 12 and for the end face of the dielectric 5 to be positioned directly on the projection 20. In this case, the projection 20 and the separation element 12 would be formed in a single piece. Preferably, however, the projection 20 and the separation element are formed in two pieces, in such a way that the separation element 12 is a separate separation element, which is preferably positioned on the projection 20.

Figure 7B:
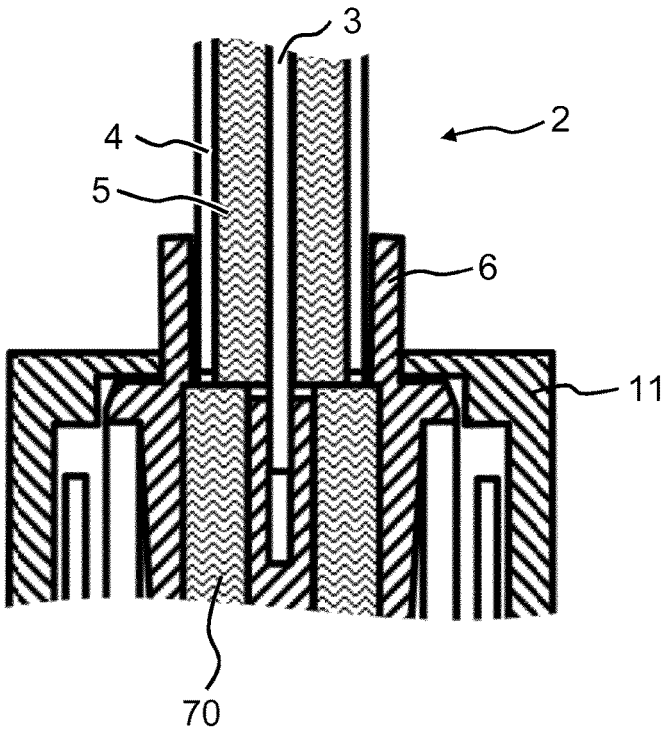
FIG. 7B is a simplified drawing of the plug connector according to the invention for receiving a coaxial cable, the dielectric of the coaxial cable protruding beyond the outer conductor.

FIG. 7B is a simplified drawing of the plug connector 1 according to the invention for receiving a coaxial cable 2, the dielectric 5 of the coaxial cable 2 protruding beyond the outer conductor 4. In this embodiment, the dielectric 5 of the coaxial cable 2 is positioned on the dielectric 70 of the plug connector 1. In this case, the dielectric 70 of the plug connector 1 acts as the separation element 12. A separate separation element is therefore not required. The outer conductor 4 of the coaxial cable 2 therefore cannot be electrically contacted at the end face thereof. In this case, it would also be possible for the dielectric 5 of the coaxial cable 2 not to protrude beyond the outer conductor 4, in such a way that the end face of the outer conductor 4 is likewise positioned on the dielectric 70 of the plug connector 1. The outer conductor 4 could also in principle project into the dielectric 70 of the plug connector 1.

Figure 7C:
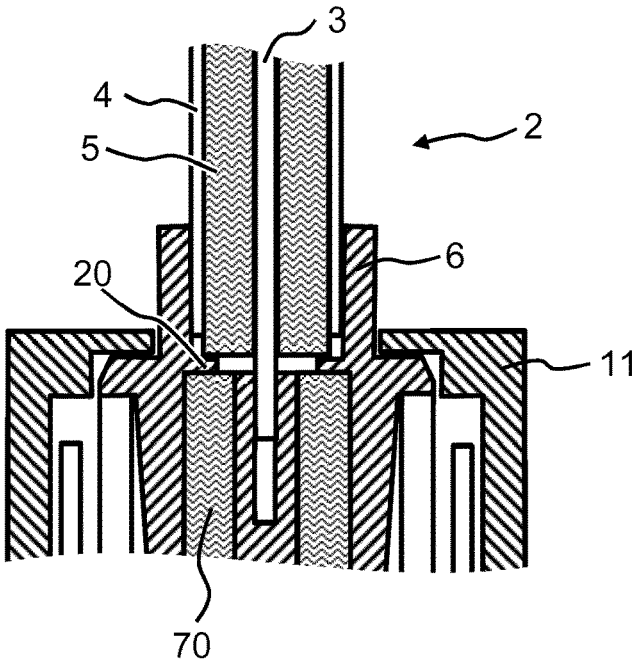
FIG. 7C is another simplified drawing of the plug connector according to the invention for receiving a coaxial cable, the dielectric of the coaxial cable protruding beyond the outer conductor.

FIG. 7C is another simplified drawing of the plug connector 1 according to the invention for receiving a coaxial cable 2, the dielectric 5 of the coaxial cable 2 protruding beyond the outer conductor 4. In this case, the dielectric 5 of the coaxial cable 2 is supported on the projection 20 of the outer conductor socket 6. There is therefore no electrical connection to the outer conductor socket 6 via the end face of the outer conductor 4.

The invention is not limited to the described embodiments. All described and/or depicted features can be combined with one another as desired within the scope of the invention.

The invention claimed is:

1. Plug connector for receiving and contacting a coaxial cable, comprising:

an outer conductor socket for receiving the coaxial cable, a central axis passing through the outer conductor socket;

an inner conductor receiving element for receiving an inner conductor of the coaxial cable, the inner conductor receiving element being arranged so as to be centered within the outer conductor socket;

the outer conductor socket comprising at least one contact region which is configured to electrically contact an outer conductor of the coaxial cable;

the coaxial cable which is to be received or has been received being rigidly connected or connectable to at least one portion of the outer conductor socket via a mechanical fastening; and at least one separation element, which is arranged within the outer conductor socket in such a way that electrical contact of the end face of the outer conductor of a coaxial cable, which can be or has been inserted into the outer conductor socket, with the outer conductor socket is impeded or prevented, and in the plugged-in state, the contact region is arranged in the outer conductor socket in such a way that the peripheral wall, which is adjacent to the end face, of the outer conductor is electrically contactable or contacted radially.

2. Plug connector according to claim 1, wherein the electrical contact of the contact region of the outer conductor socket with the peripheral wall of the outer conductor of the coaxial cable which is to be received or has been received takes place entirely without the assistance of solder, exclusively in a solder-free manner.

3. Plug connector according to claim 1, wherein the mechanical fastening comprises or consists of a crimped and/or clamped connection.

4. Plug connector according to claim 1, wherein the outer conductor socket and the at least one contact region are formed in a single piece or in multiple pieces.

5. Plug connector according to claim 1, wherein the contact region of the outer conductor socket contacts the region at the peripheral wall of the outer conductor of the coaxial cable which can be or is supplied and which, starting at the end face, extends in the axial direction by less than 0.5 cm.

6. The plug connector of claim 1 wherein the outer conductor is electrically contactable or contacted exclusively radially.

7. Plug connector according to claim 1, wherein the contact region comprises contact ribs and/or contact ridges.

8. Plug connector according to claim 7, wherein the contact ribs and/or contact ridges are arranged so as to be uniformly and mutually offset about the central axis in the peripheral direction on the inner wall of the outer conductor socket.

9. Plug connector according to claim 7, wherein the contact ribs and/or contact ridges comprise cutting edges which extend in parallel with the central axis or helically.

10. Plug connector according to claim 9, wherein the cutting edges are formed by two side faces which taper towards one another.

11. Plug connector according to claim 1, wherein the outer conductor socket comprises a projection projecting towards the central axis, against which the end face of the outer conductor and/or against which at least part of a dielectric between the outer conductor and the inner conductor of the insertable or inserted coaxial cable is braced.

12. Plug connector according to claim 11, wherein the electrical contact between the end face of the outer conductor of the coaxial cable, which is insertable or inserted into the outer conductor socket, and the outer conductor socket is impeded or prevented:

a) the projection is formed from or coated with a dielectric material and thus forms the separation element; or b) the separation element is formed as a separate separation element, which is positioned between the projection and the end face of the outer conductor and/or of the at least one part of the dielectric of the insertable coaxial cable; or c) the dielectric of the coaxial cable protrudes beyond the outer conductor at the end face and is braced on the projections or on the separation element or on a dielectric of the plug connector.

13. Plug connector according to claim 11, wherein the projection and the outer conductor socket and/or contact region are at an angle to one another which is in the range between 80° and 100°.

14. Plug connector according to claim 11, wherein the separation element comprises or consists of a disc which has in the center thereof an opening for the passage of the inner conductor of the coaxial cable, and in that the external diameter of the disc is greater than or equal to the external diameter of the outer conductor of the insertable or inserted coaxial cable.

15. Plug connector according to claim 14, wherein the separation element has, on the face thereof facing the end face of a coaxial cable which is to be received or has been received, a conical or pyramidal elevation, through which the opening for receiving the inner conductor of the coaxial cable which is to be received or has been received passes in the region of the central axis.

16. Plug connector according to claim 1, wherein an end portion of the outer conductor socket, at which portion the mechanical fastening engages, is at an axial distance from the contact region via which the outer conductor socket is electrically contacted with the outer conductor of the insertable or inserted coaxial cable.

17. Plug connector according to claim 16, wherein the contact region via which the outer conductor socket is electrically contacted with the outer conductor of the insertable or inserted coaxial cable is arranged closer to the inner conductor receiving element than the end portion of the outer conductor socket, at which portion the mechanical fastening engages.

18. Plug connector according to claim 16, wherein the end portion of the outer conductor socket is positioned on the outer conductor of the coaxial cable to be fastened, and a clamping ring is screwed radially onto the end portion of the outer conductor socket, in such a way that radial contact pressure forces act between the clamping ring and the coaxial cable to be fastened.

19. Plug connector according to claim 16, wherein the end portion of the outer conductor socket is widened radially outwards away from the central axis, forming a receiving chamber for a clamping ring, in such a way that, as a result of the clamping ring being screwed into the receiving chamber in the end portion of the outer conductor socket, radial contact pressure forces act between the clamping ring and the coaxial cable to be fastened.

20. Plug connector according to claim 19, wherein the outer conductor socket is slotted in the axial direction of the length thereof at least in the region in which the mechanical fastening is formed, and/or the clamping ring is slotted in the axial direction in part of the axial length thereof.

* * * * *